US006443063B1

(12) United States Patent
Kihara

(10) Patent No.: US 6,443,063 B1
(45) Date of Patent: Sep. 3, 2002

(54) INK SUPPLYING APPARATUS

(75) Inventor: Teruaki Kihara, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/512,794

(22) Filed: Feb. 25, 2000

(30) Foreign Application Priority Data

Jun. 3, 1999 (JP) ..... 11-156531

(51) Int. Cl.[7] ..... B41F 31/02
(52) U.S. Cl. ..... 101/364; 101/367
(58) Field of Search ..... 101/350.6, 364, 101/365, 367, 350.1, 350.2, 350.5

(56) References Cited

U.S. PATENT DOCUMENTS 3,699,888 A * 10/1972 Easuz ..... 101/365
4,058,058 A * 11/1977 Hantscho ..... 101/364
4,357,871 A * 11/1982 Köbler et al. ..... 101/364
4,700,631 A * 10/1987 Jurinak ..... 101/364
4,709,635 A * 12/1987 Kubert et al. ..... 101/365
4,854,234 A * 8/1989 Emery et al. ..... 101/364
5,003,875 A * 4/1991 Shriver ..... 101/350.6
5,088,402 A * 2/1992 Hyener et al. ..... 101/364
5,279,223 A * 1/1994 Hachiya ..... 101/364
6,062,139 A * 5/2000 Tomita et al. ..... 101/365
6,339,989 B1 * 1/2002 Fujimoto et al. ..... 101/367

* cited by examiner

*Primary Examiner*—Eugene Eickholt
(74) *Attorney, Agent, or Firm*—Armstrong, Westerman and Hattori, LLP

(57) ABSTRACT

The present invention relates to an ink supplying apparatus capable of achieving labor-saving of the cleaning operation and shortening of the working time at ink replacement or the like in a printing press. This ink supplying apparatus is equipped with an ink tray provided in the interior of an ink fountain and having a bottom plate which covers upper surfaces of ink keys, and further equipped with a deflection restraining structure for supporting the bottom plate from below to restrain the deflection of the ink tray.

18 Claims, 17 Drawing Sheets

INK SUPPLYING APPARATUS

BACKGROUND OF THE INVENTION

1) Field of the Invention

The present invention relates to an ink supplying apparatus for use in a printing press such as a rotary press or a sheet-fed printing press, and more particularly to an ink supplying apparatus equipped with an ink tray attachable/detachable to an ink fountain.

2) Description of the Related Art

As FIGS. 16 and 17 show, a printing press such as a rotary press or a sheet-fed printing press is provided with an ink supplying apparatus 100 in which an ink fountain 102 is placed in front of an ink fountain roller 101. The ink fountain 102 is composed of a circumferential surface of the ink fountain roller 101, a plurality of ink keys (blades) 103 constituting a bottom section of the ink fountain 102, and two side plates 104 (only one on the interior side is shown in FIG. 16) provided at both side surfaces of each of the ink keys 103 so that their front edges come into contact with the circumferential surface of the ink fountain roller 101 to slide thereon. In this construction, an ink lying within the ink fountain 102 is supplied through a gap between the ink fountain roller 101 and the tip portion of each of the ink keys 103 to the ink fountain roller 101 and then transferred through a non-shown ink ductor roller to a group of ink rollers lying on the downstream side.

The plurality of ink keys 103 are, as shown in FIG. 17, arranged in parallel with each other in a lateral direction of the apparatus so that the ink keys 103, 103 adjacent to each other are brought into contact with each other while both the end ink keys 103 and the side plates 104 are brought into contact with each other. In addition, the ink keys 103 are made to be driven independently of each other to rock or swing about a supporting shaft 105, and an ink quantity control device 106 is situated under the respective ink keys 103.

The ink quantity control device 106 is provided with an adjusting cam 106*b* engaging with a lower surface of the tip portion of each of the ink keys 103 and a pusher 106*a* brought into contact with the adjusting cam 106*b* to rock the adjusting cam 106*b* by its telescopic motion, namely, protruding/retracting movements. Additionally, the tip portion of each of the ink keys 103 is driven to rock in a manner that the pusher 106*a* is operated appropriately to protrude/retract for rocking the adjusting cam 106*b* so that its engaging portion of the adjusting cam 106*b* with the ink key 103 lifts/lowers, thereby controlling the gap between the ink key 103 and the ink fountain roller 101 to adjust the thickness of the ink film to be supplied.

Meanwhile, in the aforesaid conventional ink supplying apparatus 100, a microscopic gap is secured between the adjacent ink keys 103, 103 and between both the end ink keys 103 and the side plates 104 in order to permit the mutual sliding motion. Accordingly, there is a possibility that the ink permeates through the very small gap, for example, between the ink keys 103, 103 by the capillary phenomenon or the like. If the ink is hardened after permeating through the gap between the ink keys 103, 103, the operation of the ink keys 103 becomes unstable and the worst case reaches the difficulty of movement thereof, so that a problem exists in that the high-accuracy control of the ink film becomes impossible.

In addition, after the completion of printing or in the ink replacement, although there is a need to clean the interior of the ink fountain 102 by wiping off the ink remaining in the interior of the ink fountain 102 with a waste or the like, or by washing it off with a cleaning solvent, the removal of the ink is difficult because the ink shows a high viscosity. Particularly, difficulty is experienced in removing the ink permeating into the gap between the ink keys 103, 103 so that a severe burden falls on the cleaning worker. Still additionally, although, for improving the productivity, there is a need to shorten the preparation for the order change for enhancing the availability factor of the apparatus, if the load on the cleaning in the ink replacement is severe as mentioned above, the cleaning takes time largely. For this reason, it has been desired strongly to relieve the burden to be imposed on the worker through the labor-saving in the cleaning operation and further to enhance the availability factor of the apparatus through the shortening of the cleaning time.

SUMMARY OF THE INVENTION

The present invention has been developed in consideration of the above-mentioned problems, and it is therefore an object of the invention to provide an ink supplying apparatus which is capable of achieving the labor-saving of the cleaning operation and the shortening of the working time in ink replacement or the like of a printing press.

For this purpose, an ink supplying apparatus according to this invention involves the following features.

That is, an ink supplying apparatus according to this invention is equipped with an ink fountain roller, left- and right-hand side plates brought into sliding contact with a circumferential surface of the ink fountain roller to constitute a side wall section of an ink fountain, a plurality of ink keys arranged in parallel with each other to constitute a bottom section of the ink fountain and a supporting base for supporting the side plates and the plurality of ink keys, the ink supporting apparatus is characterized by comprising an ink tray having a bottom plate placed in the interior of the ink fountain for covering upper surfaces of the ink keys and a deflection restraining structure for supporting the bottom plate from below to restrain a deflection or bending of the ink tray.

In this way, since the ink tray covering the upper surfaces of the ink keys is provided in the interior of the ink fountain, the contact area of the ink keys with the ink is reducible considerably to reduce the possibility of the permeation of the ink into the gap between the ink keys, thereby stabilizing the operations of the ink keys and shortening the cleaning time of the interior of the ink fountain to improve the productivity. In addition, at the mounting of the ink tray in the ink fountain, since the deflection restraining structure supports the bottom plate from below to limit the deflection thereof, the weight reduction of the ink tray becomes feasible to provide easy handling of the ink tray, thus further improving the productivity.

Preferably, the aforesaid deflection restraining structure is made up of a supporting member protruding downwardly from a bottom surface of the bottom plate and a through hole made from an upper surface of the ink key to a bottom surface thereof so that, when the ink tray is mounted in the ink fountain, a lower end portion of the supporting member is brought into contact with the supporting base in a state of passing through the through hole to support the bottom plate.

With this construction, the deflection restraining structure can support the bottom plate from below without interfering with the ink key.

Alternatively, the deflection restraining structure is made up of a supporting member protruding upwardly from the supporting base and a through hole made to a location of the supporting member to extend from an upper surface of the ink key to a bottom surface thereof so that, when the ink tray is mounted in the ink fountain, a tip portion of the supporting member projecting through the through hole onto an upper surface of the ink key is brought into contact with the bottom plate of the ink tray to support the bottom plate.

Also with this construction, the deflection restraining structure can support the bottom plate from below without interfering with the ink key. Additionally, because the supporting member is installed on the supporting base without being required to be placed on each of ink trays, the increase in cost is suppressible.

Preferably, the supporting member is made to be attachable/detachable to/from the supporting base. This facilitates the replacement of the supporting member and permits the cleaning in a state removed.

Still alternatively, the aforesaid deflection restraining structure is made up of a first supporting member protruding downwardly from the bottom surface of the bottom plate, a second supporting member protruding upwardly from the supporting base in connection with the first supporting member and a though hole made to the location of the second supporting member to extend from a surface of the ink key to the bottom surface so that, when the ink tray is mounted in the ink fountain, a lower end portion of the first supporting member is brought into contact with a tip portion of the second supporting member to support the bottom plate.

Similarly, with this construction, the deflection restraining structure can support the bottom plate from below without interfering with the ink key. Additionally, owing to shortening the each of the supporting members, the possibility of bending thereof is reducible at handling.

Preferably, the lower end portion of the first supporting member and the tip portion of the second supporting member are brought into contact with each other in the interior of the through hole. This eliminates the troubles in the cleaning of the surface of the ink key because the second supporting member does not appear from the surface of the ink key at the removal of the ink tray.

Furthermore, in each of the aforesaid constructions, it is also possible that the supporting member is located to support the bottom plate at a central portion of the ink tray in its cross (width) direction. Accordingly, the supporting member supports the cross-direction central portion of the ink tray showing the largest deflection, thus restraining the deflection thereof with high efficiency.

Still furthermore, it is also acceptable that a plurality of supporting members are provided in a cross direction of the apparatus. This supports the bottom plate of the ink tray in the apparatus cross direction through the use of the plurality of supporting members, thus restraining the deflection with higher efficiency.

Yet furthermore, it is also acceptable that the through hole has an elongated slit-like configuration extending in a longitudinal (forward and backward) direction of the ink key. In this case, the interference between the supporting member and the ink key is preventable.

Moreover, it is also possible that the through hole is made between the ink keys adjacent to each other.

DESCRIPTION OF THE PREFERRED EMBODIMENTS

An ink supplying apparatus according to a first embodiment of the present invention will be described hereinbelow with reference to FIGS. 1 to 7B.

Figure 1:
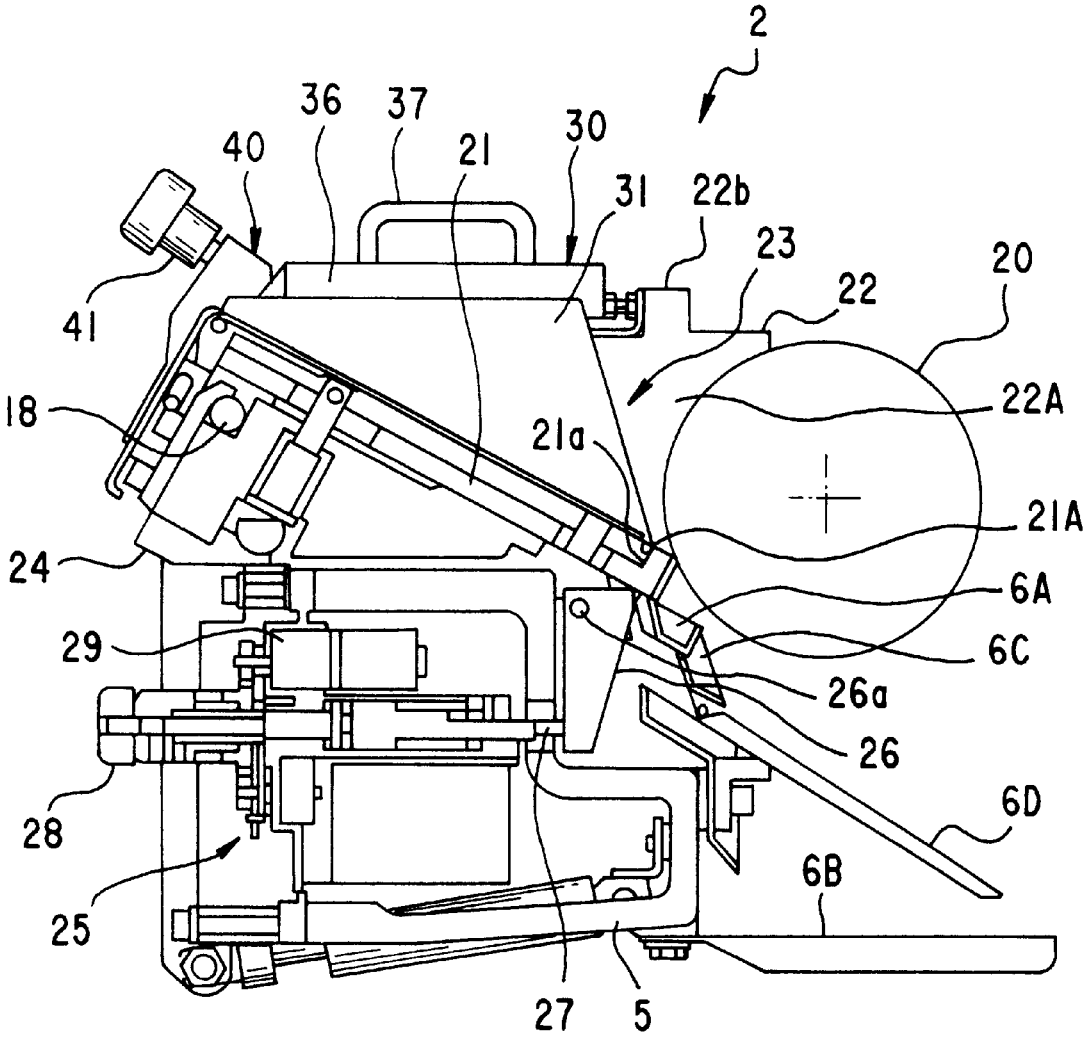
FIG. 1 is a side elevational view schematically showing a construction of an ink supplying apparatus according to a first embodiment of the present invention.

The description starts at the outline of a construction of this ink supplying apparatus. As FIG. 1 shows, the ink supplying apparatus, designated generally at reference numeral 2, is equipped with an ink fountain 23 defined by a circumferential surface of an ink fountain roller 20, ink keys 21 and side plates 22 so that an ink is put in the ink fountain 23 and supplied to the ink fountain roller 20 in printing. A plurality of ink keys 21 are arranged in a cross (transverse) direction of the apparatus in a state of coming closely into contact with each other, and their rear end portions are supported rotatably by a supporting shaft 18 set on a supporting base 24. The side plates 22 are fixedly secured onto the supporting base 24 in a state where the ink keys 21 are interposed therebetween, and their front end portions are brought into sliding contact with the circumferential surface of the ink fountain roller 20.

In addition, under the ink fountain 23, a horizontal beam 5 is installed to support components constituting the ink fountain 23, and an ink quantity control device 25 is set on this horizontal beam 5. The ink quantity control device 25 is made up of an adjusting cam 26 engaging with a lower surface of the tip portion of each of the ink keys 21, and a pusher 27 made to be brought into contact with the adjusting cam 26 at its tip portion and, further, to be protruded and retracted (extensible/contractible) in the forward and backward directions in accordance with the rotations of a knob 28 or a motor 29. Accordingly, if the pusher 27 is protruded or retracted suitably to lift or lower the adjusting cam 26 in a state where the adjusting cam 26 rocks or swings around a supporting point 26*a*, then the tip portion of each of the ink keys 21 is driven to rock, thereby controlling the gap between the ink key 21 and the ink fountain roller 20 to adjust the thickness of an ink film to be supplied thereinto. Add to it that, under the tip portions of the ink keys 21, a first ink receiver 6A is placed to receive the ink dropping from the ink keys 21 and guides 6C, 6D are situated to guide the ink from the interior of the first ink receiver 6A to a second ink receiver 6B.

Figure 2:
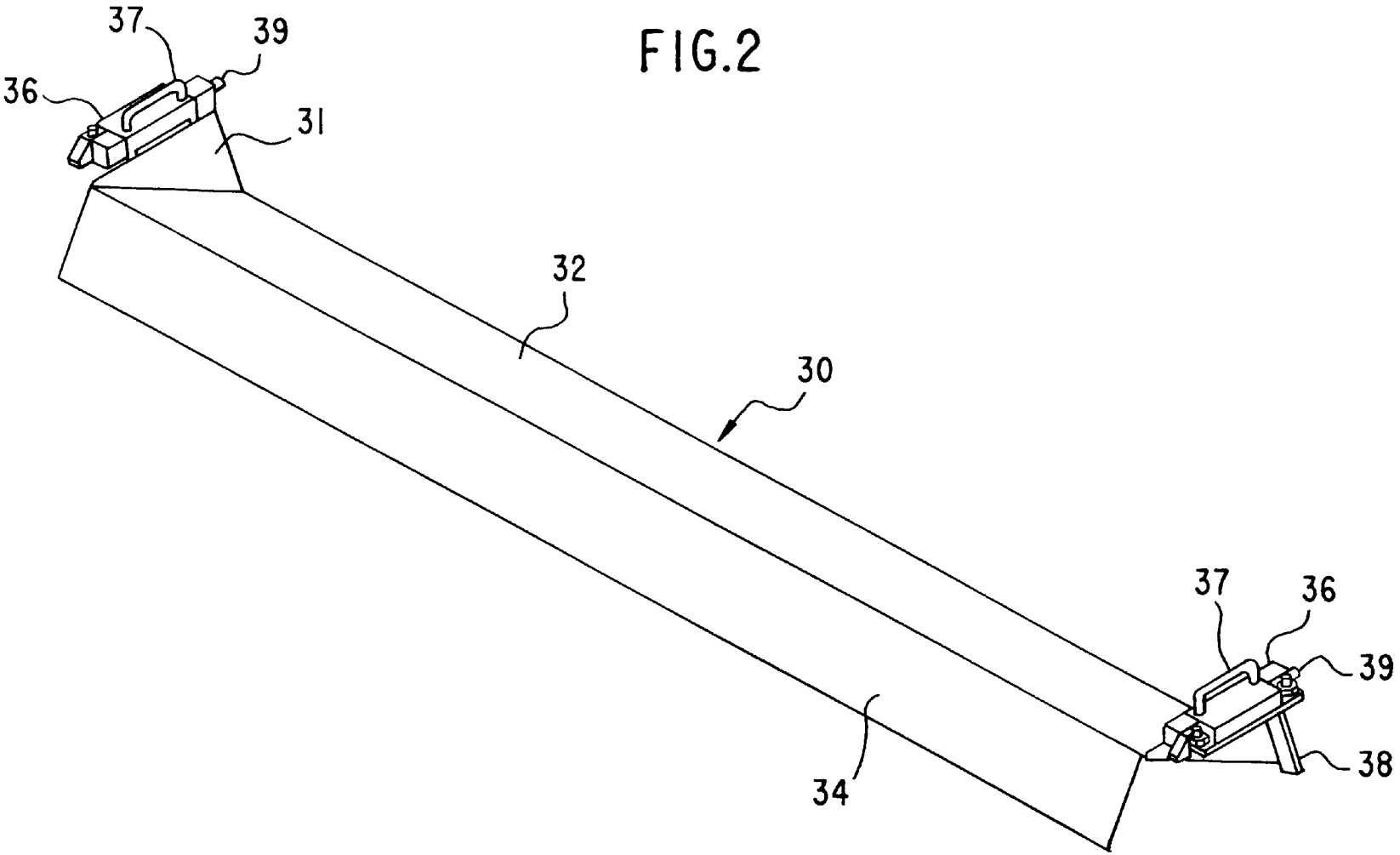
FIG. 2 is a perspective view showing a construction of an ink tray for the ink supplying apparatus according to the first embodiment of this invention.
Figure 3:
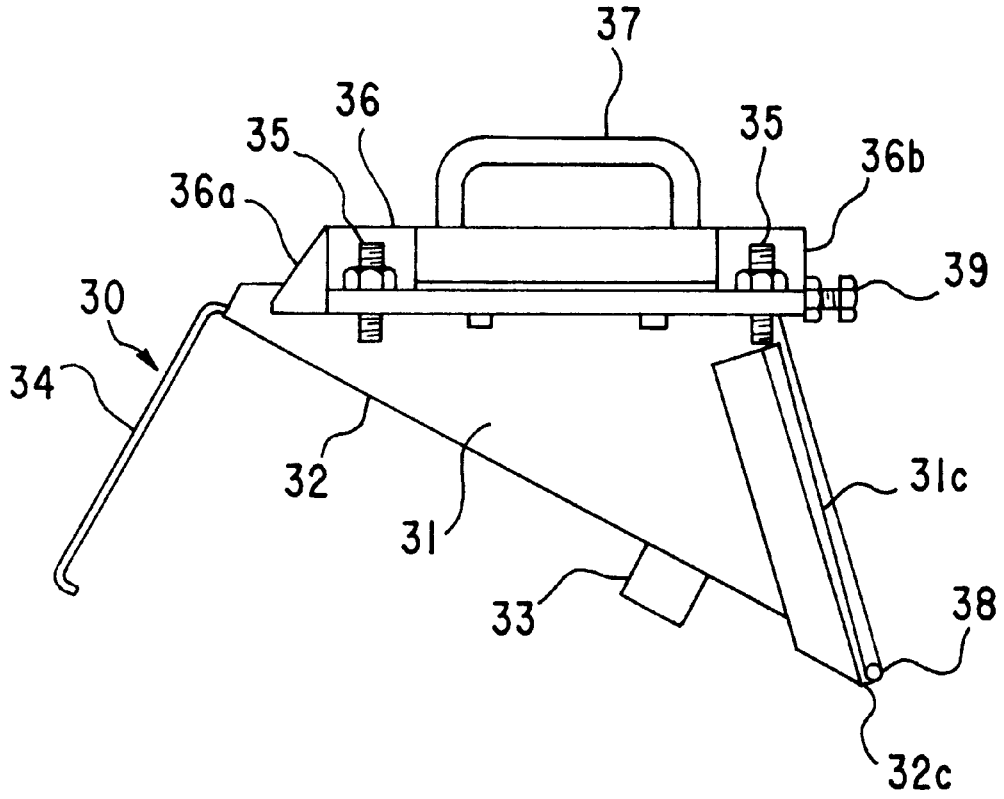
FIG. 3 is a side elevational view showing a construction of an ink tray for the ink supplying apparatus according to the first embodiment of this invention.
Figure 4:
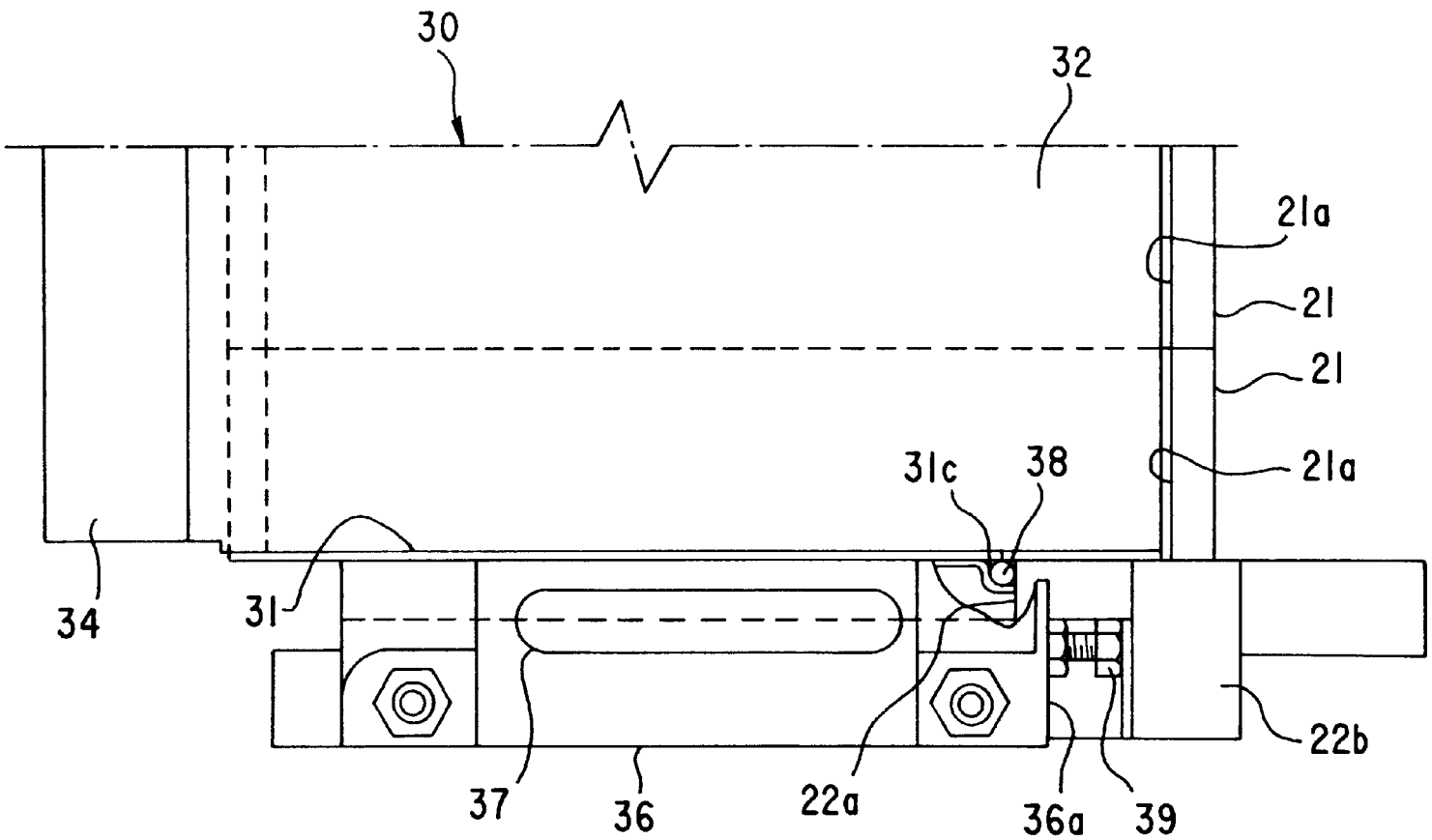
FIG. 4 is an illustration of an engaging state between an ink tray and an ink fountain in the ink supplying apparatus according to the first embodiment of this invention, with a bracket being shown partially in a broken state.

Still additionally, this ink supplying apparatus 2 is provided with an ink tray 30 placed detachably in the interior of the ink fountain 23. As FIGS. 2 to 4 show, the ink tray 30 is made up of side walls 31, 31 formed in corresponding relation to the left- and right-hand side plates 22, 22 of the ink fountain 23, and a bottom plate 32 set in a state where its tip side is tilted downwardly to the ink keys 21 constituting a bottom section of the ink fountain 23.

The rear end portion of the bottom plate 32 is extended outwardly and downwardly to form a cover 34 for preventing the adhesion of the ink to the supporting base 24. Additionally, a fin 33, serving as a supporting member, is formed on a bottom surface of the bottom plate 32. A detailed description of this fin 33 will be given herein later.

Brackets 36, 36 are fixedly secured onto the upper end portions of the side walls 31, 31 of the ink tray 30, respectively, in a state directed outwardly. When the ink tray 30 is mounted in the ink fountain 23, these brackets 36, 36 are placed on the side plates 22, 22, and the ink tray 30 is put to form a bridge between the side plates 22, 22. A handle 37 is set on an upper surface of each of the brackets 36.

This ink tray 30 covers most of the ink keys 21 and the side plates 22 (these sections will be referred to hereinafter as coated sections) so that they do not come directly into contact with the ink within the ink fountain 23, whereas the upper surface of the tip portion of each of the ink keys 21 and the inner surface of the tip portion of each of the side plates 22, which slide on the ink fountain roller 20 in a state where an ink liquid film is interposed therebetween, are exposed so as to come directly into contact with the ink within the ink fountain 23 without being covered with the ink tray 30 (these sections will be referred to hereinafter as an exposed section) That is, the inner circumferetial surface of the ink fountain 23 is formed by an inner surface of the ink tray 30, an upper surface of the exposed section (the tip portion) 21A of each of the ink keys 21, an exposed section 22A of each of the side plates 22 and an outer circumferential surface of the ink fountain roller 20.

The portion between the ink tray 30 and the tip portion (exposed section) 21A of each of the ink keys 21 or the portion between the ink tray 30 and the exposed section 22A of each of the side plates 22 constitutes a joint of the ink fountain 23, and these portions require sealing processing. For this reason, holders 31*c* and 32*c* are set in an outer surfaces of the tip portions of the side walls 31, 31 and the bottom plate 32, respectively, with a packing (sealing member) 38 having a continuous sealing surface being fitted in the holders 31*c* and 32*c*.

In a state where the ink tray 30 is mounted in the ink fountain 23, of the packing 38, portions fitted in the holders 31*c* made in the outer surfaces of the tip portions of the side walls 31 are brought under pressure into contact with steps 22*a* formed on inner surfaces of the side plates 22 of the ink fountain 23, and of the packing 38, a portion fitted in the holder 32*c* made in the outer surface of the tip portion of the bottom plate 32 is brought under pressure into contact with a step 21*a* (see FIG. 1) formed on an upper surface of the tip portion of each of the ink keys 21.

In addition, this packing 38 seals the portions between the tip portions of the side walls 31, 31 of the ink tray 30 and the side plates 22, 22 of the ink fountain 23 and the portions between the tip portion of the bottom plate 32 of the ink tray 30 and the upper surfaces of the ink keys 21 of the ink fountain 23 so that the ink leakage from the ink fountain 23 is preventable at the joints between the ink tray 30 and the ink keys 21 and between the ink tray 30 and the side plates 22.

The fixing of the ink tray 30 to the ink fountain 23 is made by a pressing device 40 (see FIG. 1) set on the supporting base 24. That is, by tightening a fixing screw 41 of the pressing device 40, rear inclined surfaces 36a (see FIG. 3) of the left- and right-hand brackets 36 are pushed toward the tip of the ink tray 30 (toward the gap between the ink keys 21 and the ink fountain roller 20) to fixedly secure the ink tray 30 in a state where the packing 38 of the ink tray 30 is pressed against the steps 22*a* and 21*a* (see FIGS. 1 and 4) of the ink fountain 23.

Furthermore, as FIGS. 1 to 4 show, bolts 39 for positioning the ink tray 30 are set in front end portions 36*b* of the left- and right-hand brackets 36. The mounting position of the ink tray 30 in the forward and backward directions is determined in a manner that these positioning bolts 39 are brought into contact with projecting portions 22*b* formed on upper surfaces of the side plates 22. The position of the ink tray 30 in the forward and backward directions is adjustable by controlling the tightening quantity of the positioning bolts 39, while the position thereof in the vertical (height) directions is adjustable by height control screws 35 set in the brackets 36.

As described above, since the ink tray 30 is detachably set in the interior of the ink fountain 23, the contact area of the ink keys 21 with the ink is considerably reducible to lower the possibility that the ink permeates into the gap between the ink keys 21, 21, which not only stabilizes the operations of the ink keys 21 but also shortens the cleaning time of the interior of the ink fountain 23, thus improving the availability factor of the apparatus and the productivity.

Meanwhile, although the attachment/detachment of the ink tray 30 to/from the interior of the ink fountain 23 are conducted with the left- and right-hand handles 37, 37 being held by the operator, if this handling constitutes a burden imposed on the operator, the aforesaid effect of the improvement of productivity is lessened accordingly. Thus, there is a need to reduce the weight of the ink tray 30 for lightening the burden thereon in handling.

However, for the weight reduction of the ink tray 30, the bottom plate 32 and the side walls 31 are naturally made from thin steel products. In this case, since the ink tray 30 has an elongated configuration in the cross (width) direction of the apparatus as shown in FIG. 2, its cross-direction rigidity decreases so that a deflection occurs at the bottom plate 32 when it is put to form a bridge between the side plates 22, 22. Although the tip portion of the bottom plate 32 contacts with the steps 21*a* on the tip portions of the ink keys 21 in a state where the packing 38 is interposed therebetween, if consideration is given to the facility when the remaining ink is scraped out by a knife or the like for cleaning, it is desirable that the section between the bottom plate 32 and the tip portions of the ink keys 21 has a flat configuration. However, if the deflection of the bottom plate 32 occurs, a step occurs between the vicinity of the central portion of the bottom plate 32 and the tip portions of the ink keys 21, which throws hindrances in the way of scraping out the remaining ink by a knife or the like. What's worse, the deflection of the bottom plate 32 can create gaps at the contacting portions with the ink keys 21 or the side plates 22 to allow the ink leakage therefrom.

Figure 5:
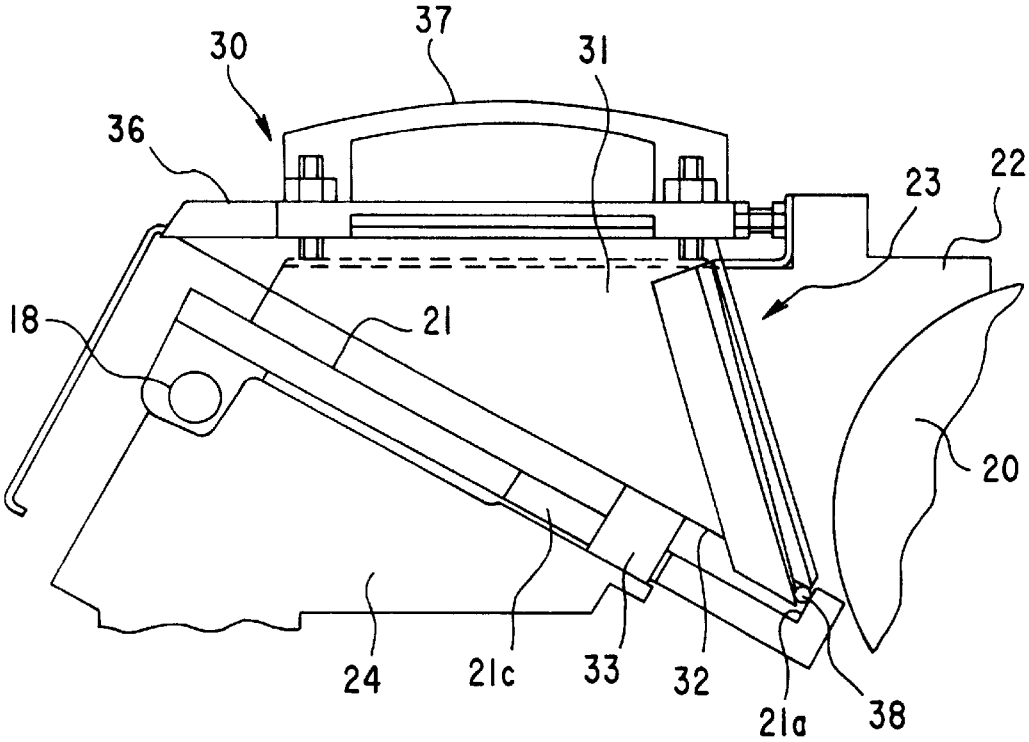
FIG. 5 is a side elevational view showing a deflection restraining structure for an ink tray in the ink supplying apparatus according to the first embodiment of this invention, where the ink tray is in a mounted condition.
Figure 6:
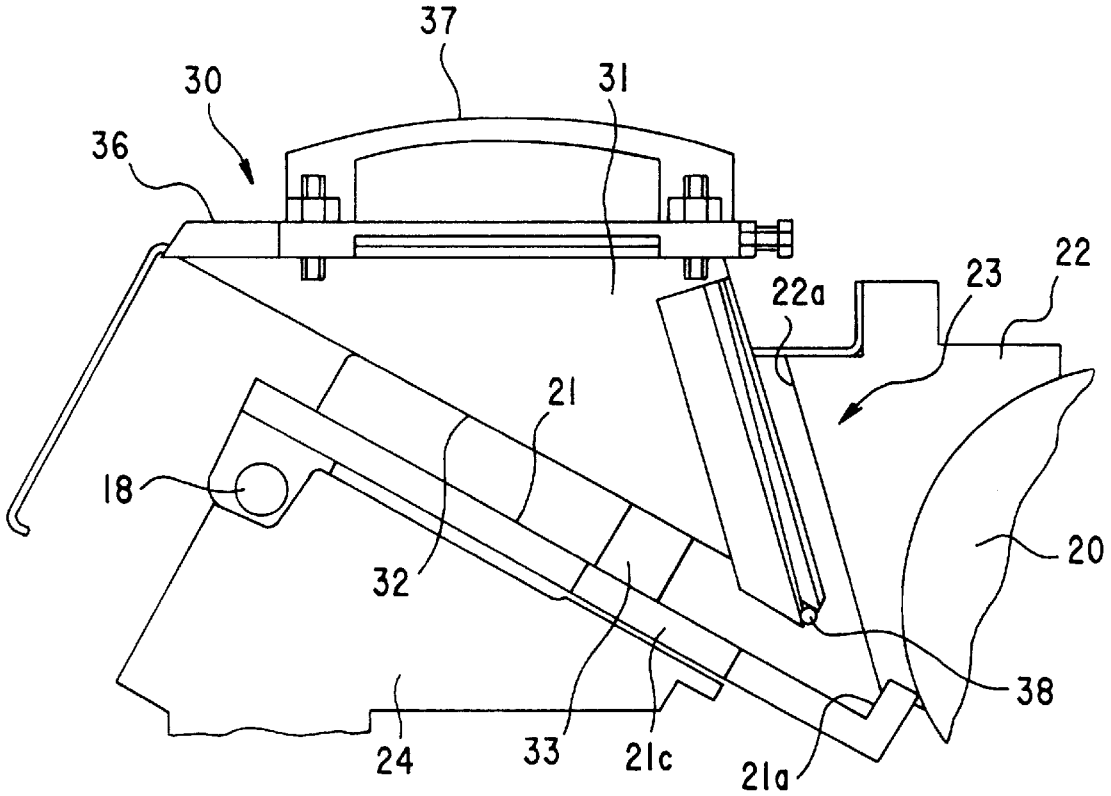
FIG. 6 is a side elevational view showing the deflection restraining structure for the ink tray in the ink supplying apparatus according to the first embodiment of this invention, where the ink tray is in a removed condition.

For this reason, in this ink supplying apparatus 2, the fin 33 is formed on the bottom surface of the bottom plate 32 of the ink tray 30 as stated above, and when the ink tray 30 is mounted in the ink fountain 23, this fin 33 supports the bottom plate 32 to restrain the deflection of the ink tray 30. This deflection restraining structure will be described hereinbelow with reference to FIGS. 5 to 7B. Incidentally, the ink tray 30 shown in FIGS. 5 and 6 is different in shapes of the brackets 36 and the handles 37 from that shown in FIGS. 1 to 4. However, these illustrations are for showing another construction of this ink tray 30, and the function thereof is substantially the same. The fin 33 is formed to have an elongated configuration in the longitudinal direction and is installed at a forward central portion of the bottom plate 32. The height of the fin 33 is set to match the distance from the bottom plate 32 to the supporting base 24 in a state where the bottom plate 32 does not deflect.

Figure 7A:
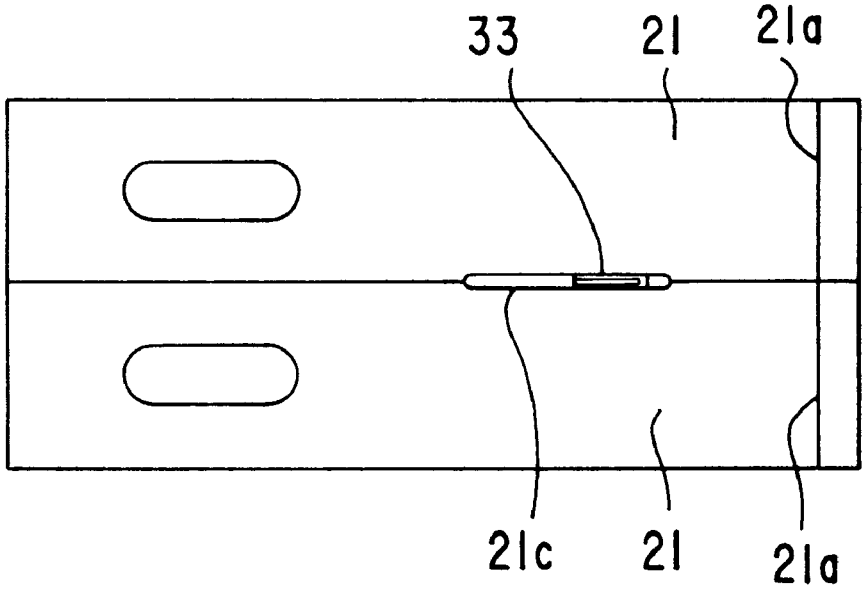
FIG. 7A is an illustration of the deflection restraining structure for the ink tray in the ink supplying apparatus according to the first embodiment of this invention, including one example of the positional relationship between a supporting member and a slit.
Figure 7B:
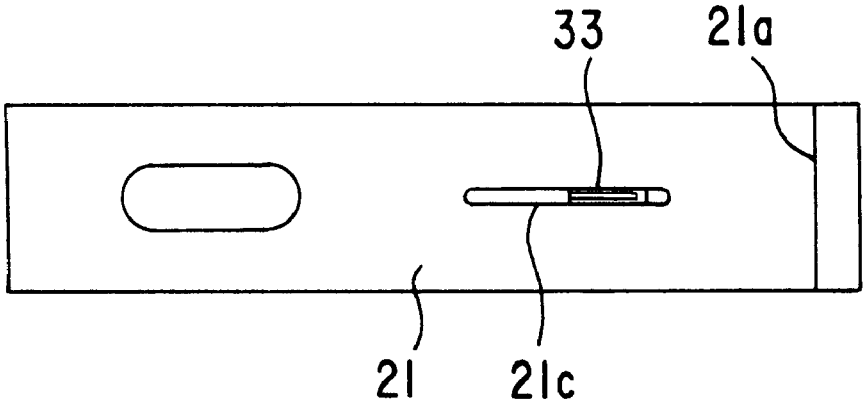
FIG. 7B is an illustration of the deflection restraining structure for the ink tray in the ink supplying apparatus according to the first embodiment of this invention, including another example of the positional relationship between a supporting member and a slit.

In addition, to the position of the fin 33 provided on the bottom plate 32, a through hole (slit) 21*c* elongated in the longitudinal (forward and backward) directions is formed as shown in FIGS. 7A and 7B.

FIG. 7A shows an example in which the fin 33 is just positioned between the ink keys 21, 21, while FIG. 7B shows an example in which the fin 33 is positioned directly above the ink key 21. The width of the slit 21*c* is set to be wider than that of the fin 33, and the length thereof in the forward and backward directions is set to afford a margin on the rear end side in consideration of the mounting angle of the ink tray 30 with respect to the ink key 21.

That is, as FIG. 6 shows, since the step 22*a* of each of the side plates 22 is set at an acute angle with respect to the ink key 21, the mounting of the ink tray 30 from the right above the ink key 21 is difficult, and it is mounted at, at least, an acuter angle than the angle the step 22*a* makes with respect to the ink key 21. Accordingly, if the length of the slit 21*c* does not afford a margin with respect to the length of the fin 33, the fin 33 interferes with the ink key 21 at the attachment/detachment of the ink tray 30. For this reason, the length of the slit 21*c* is set to have a margin on the rear end side in accordance with the mounting angle of the ink tray 30.

With the construction of the ink supplying apparatus according to the first embodiment of this invention, when the ink tray 30 is mounted in the ink fountain 23, the fin 33 formed on the bottom plate 32 comes into contact with the supporting base 24 to support the central portion of the bottom plate 32. Accordingly, the deflection of the bottom plate 32 does not occur, and the section from the bottom plate 32 to the upper surface of the tip portion of the ink key 21 is maintained flat at all times. Additionally, a proper contacting condition is maintainable between the step 21*a* of each of the ink keys 21 and the step 22*a* of each of the side plates 22.

As described above, according to this ink supplying apparatus, since the fin 33 supports the bottom plate 32 to restrain the deflection of the bottom plate 32, the ink tray 30 is constructible with thin steel products for weight reduction. Add to it that the weight reduction facilitates the handling of the ink tray 30 so that the productivity further improves. Particularly, in the case of a printing press having a large width dimension, the width dimension of the ink tray also increases so that the ink tray tends to deflect and its weight gains; therefore, the employment of this ink supplying apparatus offers a great effect in this respect.

Incidentally, in addition to the above-mentioned case in which only one fin 33 is provided at the center of the bottom plate 32, it is also appropriate that a plurality of fins 33 are provided in the cross direction. At this time, it is also possible that the method in which the slit 21*c* is formed between the ink keys 21, 21 to accept the fin 33 as shown in FIG. 7A and the method in which the slit 21*c* is made in the ink key 21 to accept the fin 33 as shown in FIG. 7B are used jointly in accordance with the location of the fin 33. In this case, because the plurality of fins 33 support the bottom plate 32, the deflection is more suppressible.

Figure 8:
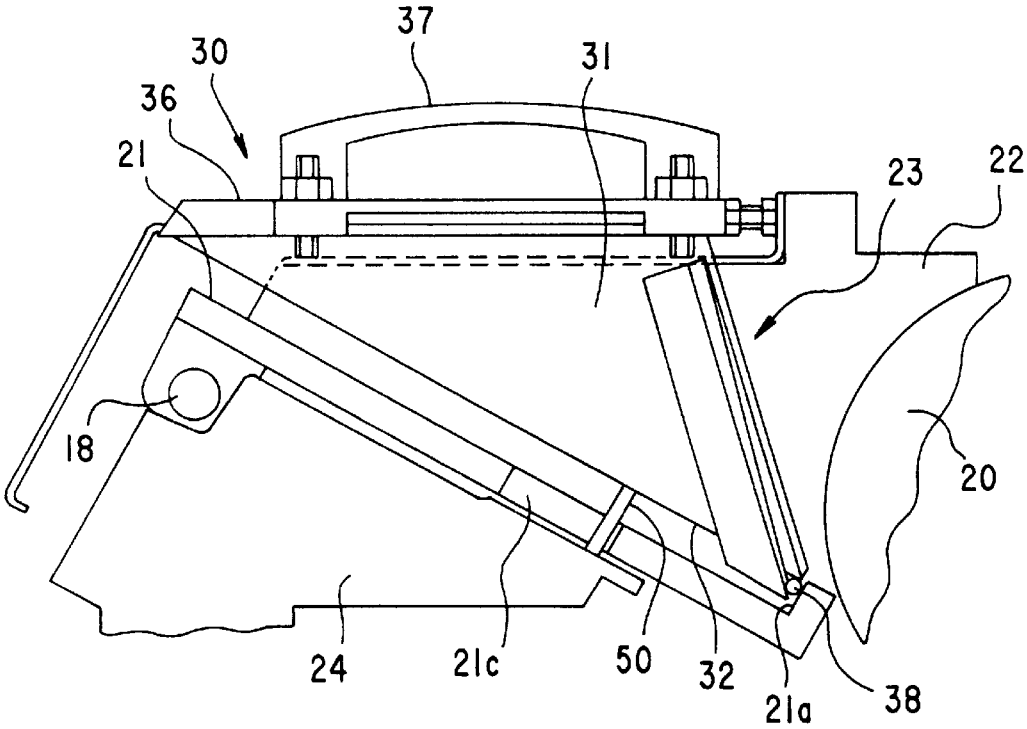
FIG. 8 is a side elevational view showing a further deflection restraining structure for an ink tray in the ink supplying apparatus according to the first embodiment of this invention, where the ink tray is in a mounted condition.
Figure 9:
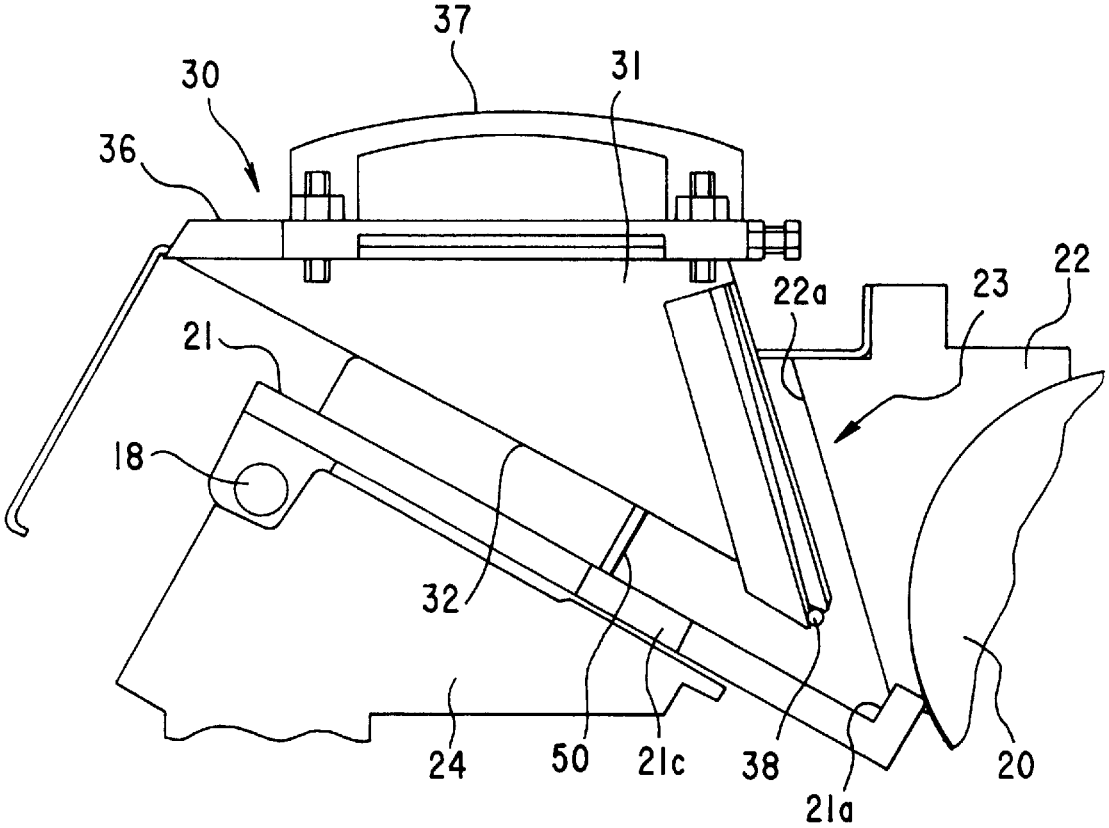
FIG. 9 is a side elevational view showing the further deflection restraining structure for the ink tray in the ink supplying apparatus according to the first embodiment of this invention, where the ink tray is in a detached condition.
Figure 10A:
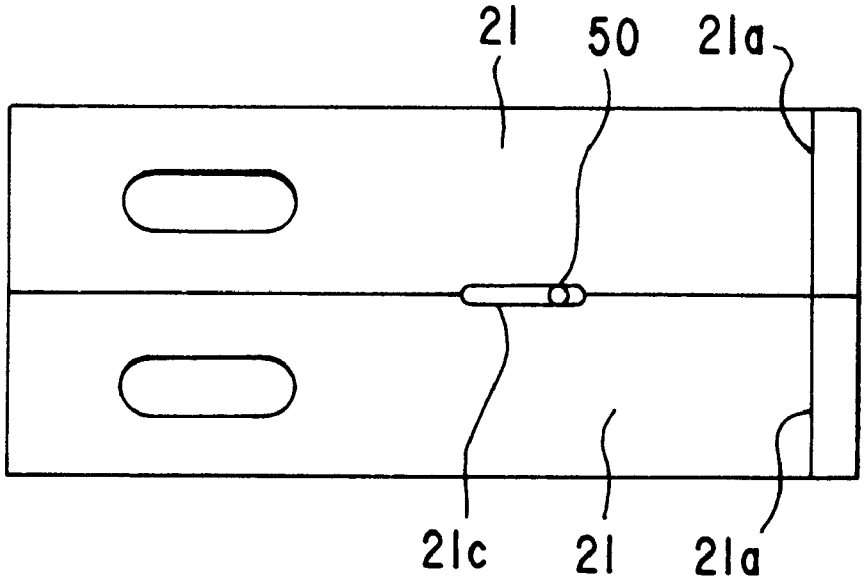
FIG. 10A is an illustration of the further deflection restraining structure for the ink tray in the ink supplying apparatus according to the first embodiment of this invention, including one example of positional relationship between a supporting member and a slit.
Figure 10B:
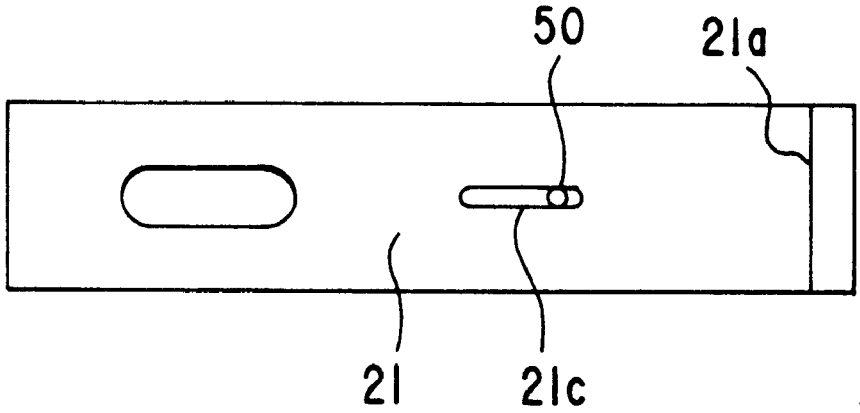
FIG. 10B is an illustration of the further deflection restraining structure for the ink tray in the ink supplying apparatus according to the first embodiment of this invention, including another example of positional relationship between a supporting member and a slit.

Furthermore, the supporting member is not limited to the aforesaid longitudinally elongated fin 33, but it is also appropriate to use a round-bar-like pin 50 as shown in FIGS. 8 to 10B. Also in this case, it is also possible that, as shown in FIG. 10A, the slit 21*a* is made between the ink keys 21, 21 to accommodate the pin 50, or that, as shown in FIG. 10B, the slit 21*c* is made in the ink key 21 to accommodate the pin 50. Also in this embodiment, as shown in FIG. 8, the slit 21*c* is formed to have a sufficient margin, namely, a length passing the position of the pin 50 at the installation of the ink tray 30 so that the pin 50 does not interfere with the ink key 21 at the attachment/detachment of the ink tray 30.

Secondly, a description will be made hereinbelow of an ink supplying apparatus according to a second embodiment of this invention. The ink supplying apparatus according to this embodiment differs in structure for supporting the bottom plate 32 of the ink tray 30 from the first embodiment. Referring to FIGS. 11 to 13B, a description will be given hereinbelow of the structure for supporting the bottom plate 32 in this ink supplying apparatus.

Figure 11:
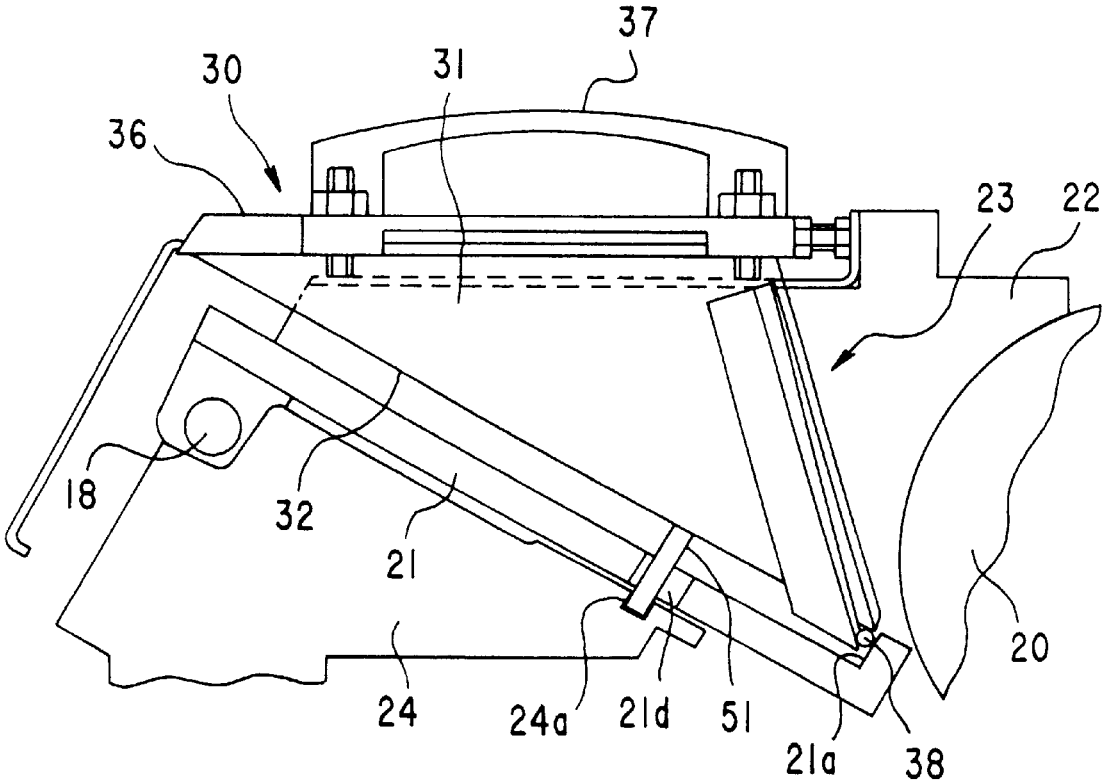
FIG. 11 is a side elevational view showing a deflection restraining structure for an ink tray in an ink supplying apparatus according to a second embodiment of this invention, where the ink tray is in a mounted condition.
Figure 12:
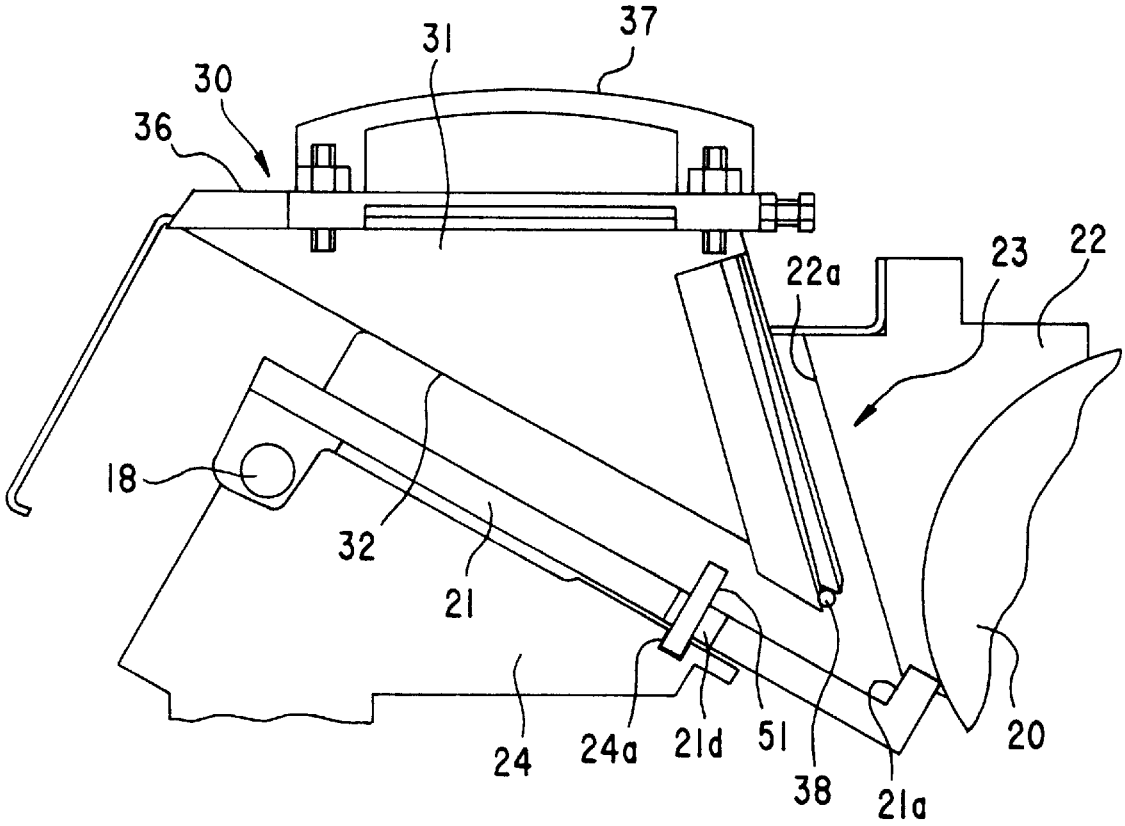
FIG. 12 is a side elevational view showing the deflection restraining structure for the ink tray in an ink supplying apparatus according to the second embodiment of this invention, where the ink tray is in a detached condition.

As FIGS. 11 and 12 show, in this ink supplying apparatus, a column 51 is planted in the supporting base 24. In the supporting base 24, a vertical hole 24*a* is bored to the position of a front end central portion of the bottom plate 32 at the mounting to the ink fountain 23, and the column 51 is fitted detachably in this vertical hole 24*a* . The height from the upper end of the column 51 to the supporting base 24 is set to match the distance from the bottom plate 32 to the supporting base 24 in the case of no occurrence of deflection of the bottom plate 32.

Figure 13A:
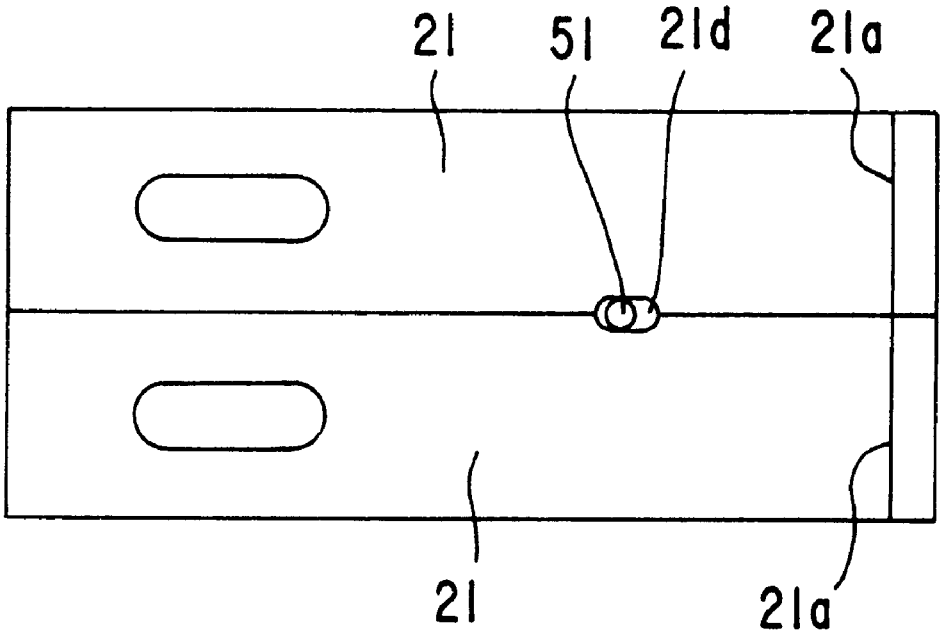
FIG. 13A is an illustration of the deflection restraining structure for the ink tray in the ink supplying apparatus according to the second embodiment of this invention, including one example of positional relationship between a supporting member and a slit.
Figure 13B:
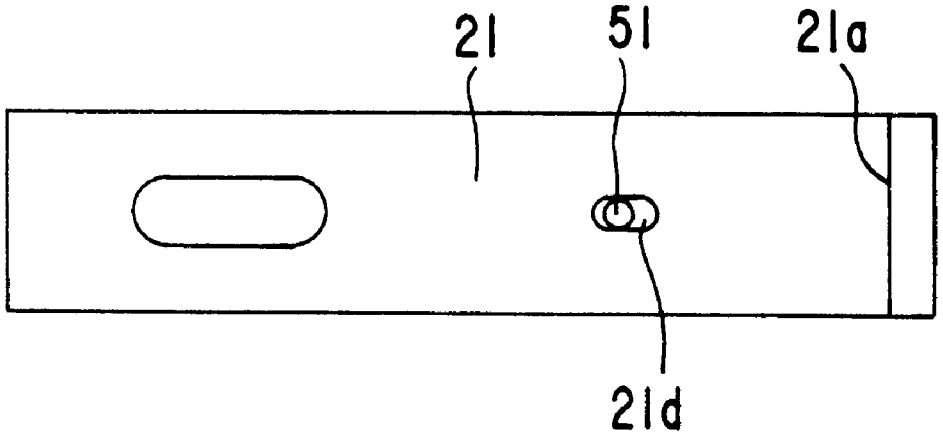
FIG. 13B is an illustration of the deflection restraining structure for the ink tray in the ink supplying apparatus according to the second embodiment of this invention, including another example of positional relationship between a supporting member and a slit.

In addition, to match the position of the column 51 installed on the supporting base 24, a through hole 21*d* is made as shown in FIGS. 13A and 13B. FIG. 13A illustrates an example in which the column 51 is positioned just between the ink keys 21, 21, while FIG. 13B illustrates an example in which the ink key 21 is positioned above the column 51. The diameter of the through hole 21*d* is set to be larger than, at least, the diameter of the column 51, and is formed to have a configuration extending toward the front end side of the ink key 21 with respect to the column 51. This is for preventing the interference between the through hole 21*d* and the column 51 which will occur when the ink key 21 is rotated around the supporting shaft 18 at cleaning, maintenance or the like.

Since the ink supplying apparatus according to the second embodiment of this invention is constructed thus, when the ink tray 30 is set in the ink fountain 23, the column 51 placed on the supporting base 24 comes into contact with the bottom plate 32 of the ink tray 30 to support the central portion of the bottom plate 32. Accordingly, the bottom plate 32 is prevented from its deflection, and the section from the bottom plate 32 to the upper surface of the tip portion of the ink key 21 is maintained in a flat condition at all times. Additionally, the contacting condition between the step 21*a* of the ink key 21 and the step 22*a* of the side plate 22 is kept properly.

As described above, according to this ink supplying apparatus, since the column 51 can support the bottom plate 32 to restrain the deflection of the bottom plate 32, as well as the first embodiment, the ink tray 30 can be made from thin steel products for the weight reduction and the handling of the ink tray 30 becomes easy, thus improving the productivity.

In addition, because a plurality of ink trays 30 are required for one ink supplying apparatus, although the first embodiment requires the fin 33 for each of the ink trays 30, this embodiment requires only the column 51 placed on the supporting base 24; therefore, the increase in cost is suppressible. Still additionally, in the case in which the fin 33 is provided for each of the ink trays 30, in many cases, the difference in precision there among exists. On the other hand, in this embodiment, since the positioning of the bottom plate 32 is accomplished by the column 51 placed on the supporting base 24, a higher accuracy is easily attainable.

Moreover, since the column 51 is attachable/detachable to/from the supporting base 24, the replacement thereof is easy and the cleaning thereof is possible in a state detached therefrom.

Incidentally, in addition to the above-mentioned case in which only one column 51 is provided to the center, it is also appropriate that a plurality of columns 51 are provided in the cross direction. At this time, it is also possible that the method in which, as shown in FIG. 13A, the through hole 21*d* is made between the ink keys 21, 21 so that the column 51 is inserted thereinto and the method in which, as shown in FIG. 13B, the through hole 21*d* is made in the ink key 21 so that the column 51 is inserted thereinto are used jointly in accordance with the location of the column 51. In this case, because the plurality of columns 51 support the bottom plate 32, the deflection is more suppressible.

In addition, the column 51 is not limited to the aforesaid detachable structure, but it is also acceptable to fixedly secure it to the supporting base 24. Still additionally, the supporting member is not limited to the aforesaid column 51 having a circular-bar-like configuration, it is also possible that it has a fin-like configuration as well as the first embodiment.

Although the two embodiments related to the ink supplying apparatus according to this invention have been described above, it should be understood that this invention is not limited to the above-described embodiments, and that it is intended to cover all changes of the embodiments in the range which does not constitute departures from the spirit of the invention. For example, it is also possible to employ a combination of the above-described two embodiments. That is, as FIGS. 14 and 15 indicate, a pin (first supporting member) 52 is provided on the bottom plate 33 of the ink tray 30 and a column (second supporting member) 53 is vertically set on the supporting base 24 to match the position of a pin 51so that the column 53 supports the pin 52, thereby preventing the occurrence of the deflection of the bottom plate 32.

Figure 14:
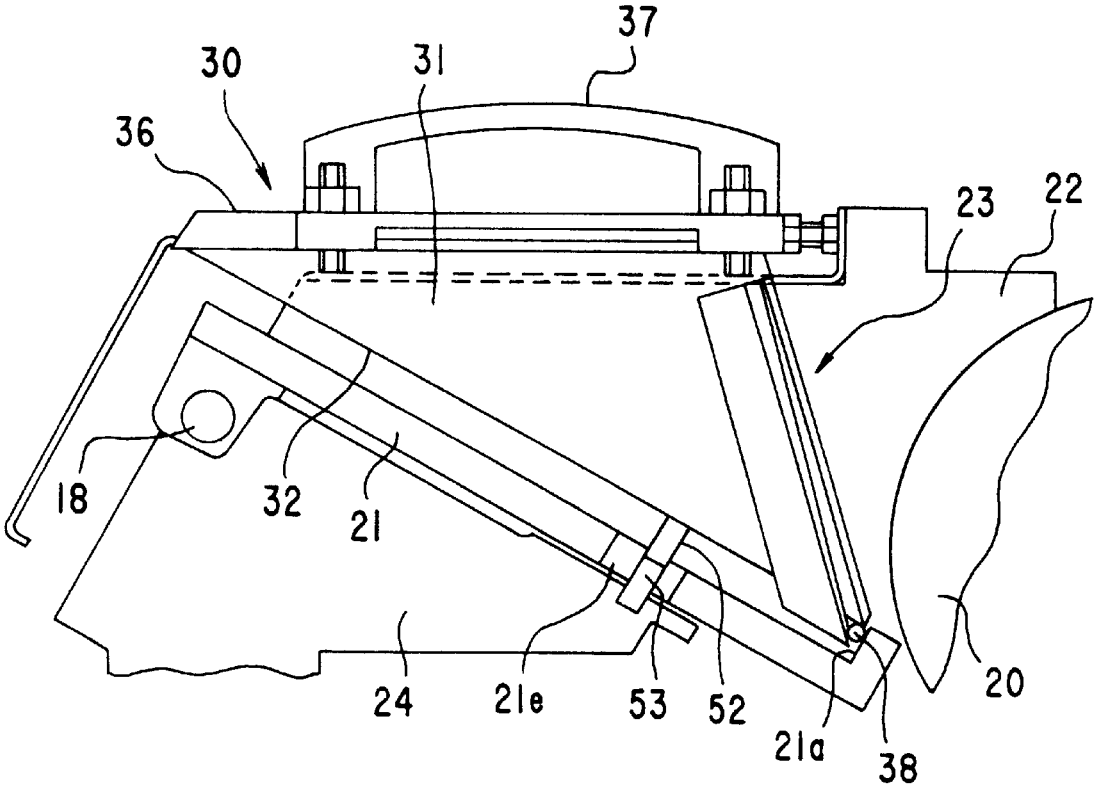
FIG. 14 is a side elevational view showing a deflection restraining structure for an ink tray according to a further embodiment of this invention, where the ink tray is in a mounted condition.
Figure 15:
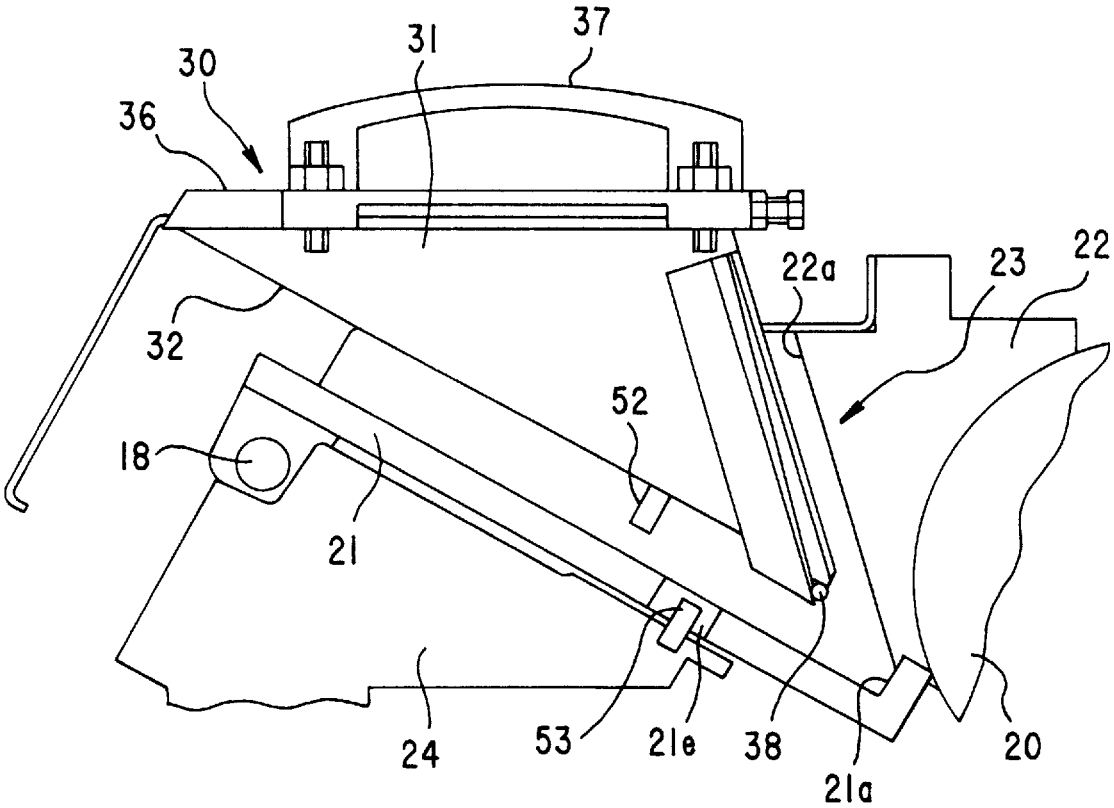
FIG. 15 is a side elevational view showing the deflection restraining structure for the ink tray according to the further embodiment of this invention, where the ink tray is in a detached condition.
Figure 16:
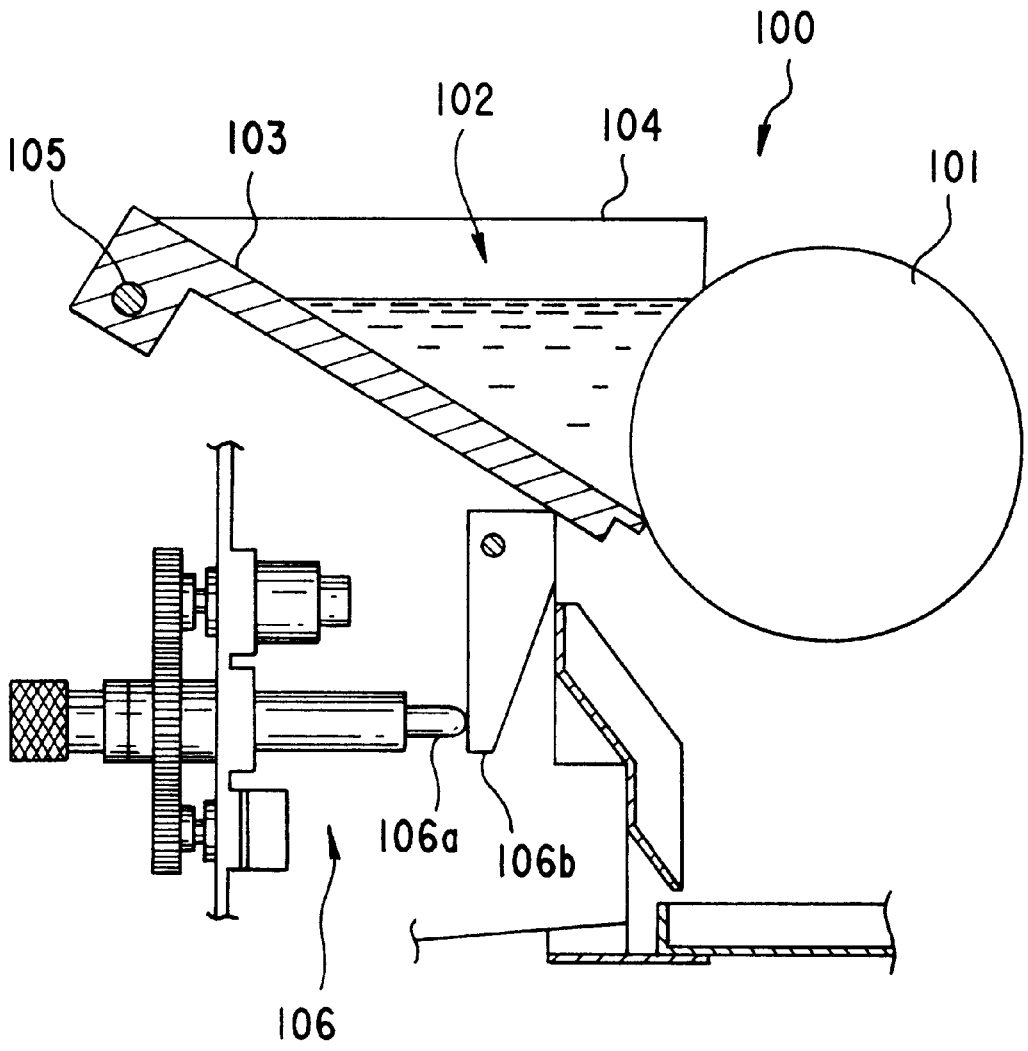
FIG.16 PRIOR ART
FIG. 16 is a side elevational view illustratively showing a construction of a conventional ink supplying apparatus.
Figure 17:
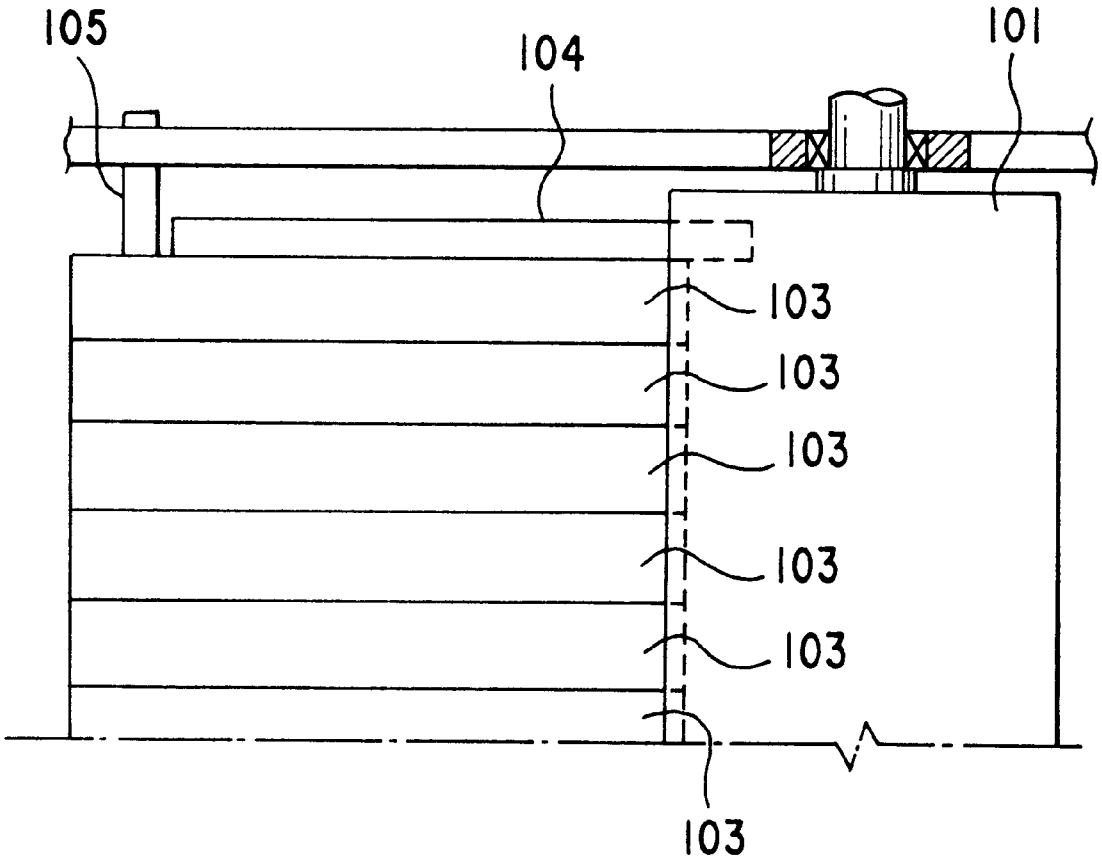
FIG.17 PRIOR ART
FIG. 17 is a top view illustratively showing the interior of an ink fountain in the construction of the conventional ink supplying apparatus.

At this time, if the pin 52 and the column 53 are, as shown in FIG. 14, made to come into contact with each other in the interior of a through hole 21*e*, when the ink tray 30 is detached therefrom, they do not appear from the surface of the ink key 21, which makes it possible to eliminate the hindrance at the cleaning of the surface of the ink key 21. Still additionally, since it is possible to shorten the length of the pin 52 set on the ink tray 30, the possibility of bending thereof decreases, thus improving the precision at the mounting thereof.

What is claimed is:

1. An ink supplying apparatus equipped with an ink fountain roller, left-and right-hand side plates brought into sliding contact with a circumferential surface of said ink fountain roller to define sidewall sections of an ink fountain, a plurality of ink keys arranged in parallel with each other to define a bottom section of said ink fountain, swinging means for swinging a tip portion of each of said ink keys to adjust an ink supply gap between said ink keys and said ink fountain roller, and a supporting base for supporting said side plates and said plurality of ink keys, said ink supplying apparatus further comprising:

an ink tray having a bottom plate placed in the interior of said ink fountain for covering upper surfaces of said ink keys without preventing a swinging motion of said ink keys, and a deflection restraining structure for supporting said bottom plate from below on the basis of said supporting base to restrain a deflection of said ink tray.

2. An ink supplying apparatus according to claim 1, wherein said deflection restraining structure includes:

a supporting member protruding downwardly from a bottom surface of said bottom plate; and a through hole made from an upper surface of said ink key to a bottom surface thereof, wherein, when said ink tray is mounted in said ink fountain, a lower end portion of said supporting member is brought into contact with said supporting base in a state of passing through said through hole to support said bottom plate.

3. An ink supplying apparatus according to claim 2, wherein said supporting member is disposed at a center of said ink tray in its cross direction.

4. An ink supplying apparatus according to claim 2, wherein a plurality of supporting members each corresponding to the first-mentioned supporting member are located in a cross direction of said apparatus.

5. An ink supplying apparatus according to claim 2, wherein said through hole is made to have an elongated slit-like configuration extending in a longitudinal direction of said ink key.

6. An ink supplying apparatus according to claim 2, wherein said through hole is made between said ink keys adjacent to each other.

7. An ink supplying apparatus according to claim 1, wherein said deflection restraining structure includes:

a supporting member protruding upwardly from said supporting base; and a through hole made to a location of said supporting member to extend from an upper surface of said ink key to a bottom surface thereof, wherein, when said ink tray is mounted in said ink fountain, a tip portion of said supporting member projecting through said through hole onto an upper surface of said ink key is brought into contact with said bottom plate of said ink tray to support said bottom plate.

8. An ink supplying apparatus according to claim 7, wherein said supporting member is made to be attachable/detachable to/from said supporting base.

9. An ink supplying apparatus according to claim 7, wherein said supporting member is located to support said bottom plate at a central portion of said ink tray in its cross direction.

10. An ink supplying apparatus according to claim 7, wherein a plurality of supporting members each corresponding to the first-mentioned supporting member are provided in a cross direction of said apparatus.

11. An ink supplying apparatus according to claim 7, wherein said through hole is made to have an elongated slit-like configuration extending in a longitudinal direction of said ink key.

12. An ink supplying apparatus according to claim 7, herein said through hole is made between said ink keys adjacent to each other.

13. An ink supplying apparatus according to claim 1, wherein said deflection restraining structure includes:

a first supporting member protruding downwardly from a bottom surface of said bottom plate;

a second supporting member protruding upwardly from said supporting base in connection with said first supporting member; and a though hole made to a location of said second supporting member to extend from an upper surface of said ink key to a bottom surface thereof, wherein, when said ink tray is mounted in said ink fountain, a lower end portion of said first supporting member is brought into contact with a tip portion of said second supporting member to support said bottom plate.

14. An ink supplying apparatus according to claim 13, wherein said lower end portion of said first supporting member and said tip portion of said second supporting member are brought into contact with each other in the interior of said through hole.

15. An ink supplying apparatus according to claim 13, wherein said first supporting member and said second supporting member are disposed to support said bottom plate at a center of said ink tray in its cross direction.

16. An ink supplying apparatus according to claim 13, wherein a plurality of first supporting members each corresponding to the first-mentioned first supporting member and a plurality of second supporting members each corresponding to the first-mentioned second supporting member are provided in a cross direction of said apparatus.

17. An ink supplying apparatus according to claim 13, wherein said through hole is made to have an elongated slit-like configuration extending in a longitudinal direction of said ink key.

18. An ink supplying apparatus according to claim 13, wherein said through hole is made between said ink keys adjacent to each other.

* * * * *